US005418205A

United States Patent [19]

Mehta et al.

[11] Patent Number: 5,418,205

[45] Date of Patent: May 23, 1995

[54] CELLULOSIC SUBSTRATE WITH TRANSPARENTIZED PORTION AND CARBONLESS IMAGING

[75] Inventors: Rajendra Mehta; A. Dale Lakes, both of Dayton, Ohio

[73] Assignee: The Standard Register Company, Dayton, Ohio

[21] Appl. No.: 45,870

[22] Filed: Apr. 15, 1993

[51] Int. Cl.[6] ..... B41M 5/40

[52] U.S. Cl. ..... 503/206; 229/71; 503/226

[58] Field of Search ..... 229/69, 71; 428/172, 428/211, 537.5; 503/200, 206, 226

[56] References Cited

U.S. PATENT DOCUMENTS

| | | | |
|---|---|---|---|
| 3,813,261 | 5/1974 | Muller | 428/264 |
| 4,137,046 | 1/1979 | Koike et al. | 428/537 |
| 4,198,465 | 4/1980 | Moore et al. | 428/409 |
| 4,237,185 | 12/1980 | Lombardi et al. | 428/337 |
| 4,271,227 | 6/1981 | Muller et al. | 428/264 |
| 4,319,811 | 3/1982 | Tu et al. | 428/520 |
| 4,416,950 | 11/1983 | Muller et al. | 428/537 |
| 4,513,056 | 4/1985 | Vernois et al. | 428/264 |
| 4,526,803 | 7/1985 | White | 427/14.1 |
| 4,569,888 | 2/1986 | Muller et al. | 428/481 |
| 4,729,506 | 3/1988 | Neubauer | 229/69 |
| 4,814,043 | 3/1989 | Rausing et al. | 162/286 |
| 5,076,489 | 12/1991 | Steidinger | 229/71 |

*Primary Examiner*—Pamela R. Schwartz

*Attorney, Agent, or Firm*—Killworth, Gottman, Hagan & Schaeff

[57] ABSTRACT

A cellulosic substrate suitable for use as an envelope or mailer is provided which includes a transparentized portion which has been impregnated with a liquid polymerizable transparentizing material which has then been cured by exposure to radiation. The transparentized portion is no thicker than the remainder of the substrate to permit stacking of the substrate. The transparentized portion may also include carbonless imaging capabilities.

26 Claims, 4 Drawing Sheets

CELLULOSIC SUBSTRATE WITH TRANSPARENTIZED PORTION AND CARBONLESS IMAGING

BACKGROUND OF THE INVENTION

The present invention relates to a cellulosic substrate suitable for use as an envelope or mailer and, more particularly, to one having at least one transparentized portion.

As is known, various types of envelopes or mailers with transparent windows exist where the window consists of a cut-out opening in the mailer substrate which is covered by a transparent patch. The transparent patch is usually secured over the cut-out opening by means of an adhesive, and may consist of any suitable film of transparent material such as glassine, cellophane, or polymeric materials including polyester, polyethylene, polycarbonate, polystyrene, and polyethylene terephthalate. The adhesive is generally applied to the mailer substrate around the perimeter of the cut-out opening to join the outer perimeter of the transparent patch thereto. The transparent patch can be secured to either the inside or outside surface of the mailer substrate.

In some modern mailing systems, a mailer is formed from a single sheet after it has been imaged by a non-impact printer. These sheets are stacked in the input hopper and fed as single plies through the printer, after which the sheets are folded to form a mailer. A window is provided to permit the name and address to show through. Added thickness caused by patches over die-cut windows causes mis-shapen stacks and prevents trouble-free feeding.

The typical arrangement of such patches is disadvantageous in that, since the transparent patch is layered on top of or below the substrate, the thickness of the window portion of the sheet is greater than that of the remainder of the sheet. As a consequence, such sheets form unstable and uneven stacks, and thus limit the maximum height to which they can be stacked. This stack-height limitation is burdensome to large scale manufacturing operations, such as printing.

Another disadvantage with mailers having a cut-out opening covered by a transparent patch is that the edges of the transparent patch often get caught by process machinery, such as printers. This results in the destruction of the mailer and usually requires the machinery to be stopped so that the destroyed mailer can be removed. Moreover, when heat is employed in such process machinery, the adhesive holding the transparent patch to the mailer substrate can soften, causing the patch to become detached from the mailer substrate.

One alternative to the cut-out/transparent patch type of arrangement is to apply a transparentizing material to a predetermined portion of the mailer substrate to thereby form a window. Such a method entails the impregnation of the mailer substrate with transparentizing material. The spaces between the fibers of the substrate are filled by the transparentizing material. In order to make the impregnated portion transparent, the transparentizing material must have a refractive index close to that of cellulose (1.5). Examples of conventional transparentizing methods and materials are disclosed in U.S. Pat. No. 3,813,261 to Muller, U.S. Pat. No. 4,137,046 to Koike et al., and U.S. Pat. No. 4,198,465 to Moore et al.

In order to produce high quality mailers on a large, industrial scale by employing a transparentizing material, it is desirable that the transparentizing material be capable of achieving three important functions:

1) the ability to quickly penetrate the mailer substrate in order to fully impregnate the substrate in the shortest time possible;
2) the ability to be converted quickly from a penetrating liquid to a solid after impregnation has occurred; and
3) the ability to produce a transparentized portion which possesses a number of physical and chemical properties, the details of which will be discussed below. The drawback to producing mailers in this manner, however, is that currently available transparentizing materials can perform, at most, only one of the aforementioned functions.

The rate at which some conventional transparentizing materials penetrate a cellulosic substrate is so slow that, after applying the transparentizing material to the substrate, the substrate must be wound up in a tight roll for a period of time to allow the material to impregnate the substrate. See, for example, U.S. Pat. No. 4,416,950 to Muller et al. Such materials are not conducive to the high-speed production of mailers having transparentized windows.

It is known to include a solvent with the transparentizing material to lower the viscosity thereof and thereby speed the rate of penetration of the transparentizing material into the mailer substrate (see, e.g., U.S. Pat. No. 4,513,056 to Vernios et al). However, the use of solvents with transparentizing materials is undesirable due the added process machinery and expense which are necessary to evaporate the solvent from the substrate surface and to recover the evaporated solvent.

As mentioned, the transparentized portion of a mailer preferably should possess certain physical and chemical properties. Physically, the transparentized portion should be strong and flexible (i.e. not brittle) and be receptive to inks. Chemically, the transparentized portion should have sufficient resistance to ultraviolet radiation that it does not yellow and/or lose its transparency over time; should meet U.S. Postal Service specifications for reflectance (sufficient transparency to read the printing beneath the transparentized portion) and PCR ("Print Contrast Ratio"—sufficient contrast between the printing and background beneath the transparentized portion); and should have sufficient resistance to migration and/or volatilization of the transparentizing material from the place where applied on the mailer substrate such that it does not lose its transparency over time.

Conventional transparentizing materials which may be capable of somewhat faster penetration rates are not capable of producing transparentized portions which possess the aforementioned physical and chemical properties. U.S. Pat. No. 5,076,489 to Steidinger, for example, discloses using either wax or oil as the transparentizing material. Wax produces a brittle transparentized area which is easily marred by physical contact therewith to cause a loss of transparency. In addition, wax is not receptive to inks and therefore cannot be printed upon. Oil tends to migrate and/or volatilize easily, thus resulting in a loss of transparency over time.

As a further example, Lombardi et al, U.S. Pat. No. 4,237,185, discloses a transparentizing material containing an aromatic acrylate oligomer (an acrylated monofunctional epoxidized novolac). It has been found that when oligomers (or monomers) having an aromatic structure are included in a transparentizing material, the transparentized area produced thereby yellows and/or loses its transparency over time.

Accordingly, it is seen that a need exists in the art for a substrate suitable for use as a mailer or envelope having at least one transparentized portion which can be placed in tall, stable stacks; which does not have equipment-catching edges around the window area; and which, if produced by transparentizing a portion of the mailer substrate, can be transparentized quickly and yet produce a transparentized portion which has the desired physical and chemical properties recited above.

SUMMARY OF THE INVENTION

Those needs are met by the present invention which provides a cellulosic substrate which has at least one transparentized portion and preferably in which a smooth interface exists between the transparentized portion and the remainder of the substrate. In addition, the transparentized portion preferably has a thickness which is no greater than the thickness of the remainder of the substrate. Thus, no machine-catching edges are present, and mailers made from the substrate will form tall, stable stacks due to the ability to form transparent windows without adding thickness to the substrate. Moreover, the present invention also provides a 100% solids liquid transparentizing material which penetrates the mailer substrate quickly and completely, and forms a cured polymeric transparentized portion which possesses the aforementioned physical and chemical properties. In this manner, a high-quality transparentized portion can be formed on mailer substrates in a continuous, in-line process without the need for evaporating or recovering a solvent.

The present invention generally provides a cellulosic substrate suitable for use as an envelope or mailer. The cellulosic substrate has at least one transparentized portion which comprises an area on the substrate which has been impregnated with a polymerized transparentizing material. In certain embodiments, the transparentized portion is thinner than the remainder of the substrate. Preferably, the transparentized portion has a smooth interface between itself and the remainder of the substrate, and the transparentized portion has a thickness which is no greater than the thickness of the remainder of the substrate. By a smooth interface, we mean one in which no loose or sharp edges are present which could get caught in process equipment and cause jams or tears. By transparentized, we mean that there is sufficient transparency to read printing beneath the transparentized portion of the substrate (reflectance of at least 50% in the red spectrum and at least 45% in the green spectrum), and sufficient contrast between the printing and background portion beneath the transparentized portion to provide a print contrast ratio of at least 30%.

The transparentized portion of the present invention comprises an area of the substrate which is impregnated with a polymeric transparentizing material comprising at least one monomer selected from the group consisting of acrylic esters of polyhydric alcohols, methacrylic esters of polyhydric alcohols, and vinyl ethers which have been cured by exposure to radiation. Such monomers are characterized by having one or more ethylenically unsaturated groups per monomer molecule. In one embodiment, in which the transparentized portion is impregnated with the above-recited radiation curable fluid, the radiation curable fluid is preferably applied as 100% solids (i.e., solventless) liquid. Application in such a manner is advantageous in that the use of the above-recited monomers, without oligomers or prepolymers, causes the liquid to penetrate the cellulosic substrate quickly and completely. In addition, radiation curing of the liquid is preferred in that it is faster and more reliable than other forms of curing such as, for example, heat curing. These features thus permit continuous, in-line transparentization. Another advantage of the above-recited monomeric liquid is that quick penetration is achieved without the need for solvents. Thus, the liquid which is applied can be a 100% solids composition to eliminate the need for evaporation and recovery of solvent from the substrate.

A further advantage of the use of the above-recited monomers, without oligomers or prepolymers, is that even though the liquid penetrates the substrate very quickly, the transparentized portion produced by the coating is a high quality one. Physically, the transparentized portion is strong and flexible and is highly receptive to inks. An advantage of such good receptivity to inks is that it allows a reverse image to be printed on the lower surface of the transparentized portion. In this manner, the reverse image is visible as a normal image through the upper surface of the transparentized portion.

Chemically, the transparentized portion of the present invention has sufficient resistance to ultraviolet radiation that it does not yellow and/or lose its transparency over time. It is believed that such resistance to ultraviolet radiation is a result of the aliphatic, as opposed to aromatic, structure of the above-recited monomers. Further, the transparentized portion meets U.S. Postal Service specifications for reflectance and PCR. This is believed possible due to the fact that the above-recited monomers penetrate the substrate substantially completely. Additionally, the present transparentized portion has sufficient resistance to migration and/or volatilization of the radiation cured material that it does not lose its transparency over time. This advantage is believed due to the facts that the liquid which is applied is 100% solids, and the liquid transparentizing material can be radiation cured almost immediately after it has been applied to the substrate since it penetrates the substrate so quickly.

Although the radiation curable transparentizing material of the present invention penetrates the fastest when the above-recited monomers are used without oligomers or prepolymers, there may be occasions when the need for specific physical and/or chemical properties in the transparentized portion outweigh the need for high speed penetration. In such circumstances, oligomers and/or prepolymers may be included in the coating. For example, it may be desirable to include one or more prepolymers with the coating if, due to the nature of the cellulosic substrate, for instance, it were necessary to adjust the refractive index of the coating in order to ensure that the cured coating has a refractive index close to that of the cellulosic substrate. The preferred prepolymers for this purpose are selected from the group consisting of styrene-maleic anhydride prepolymer, styrene-acrylic acid prepolymer, and styrene-methacrylic acid prepolymer. Similarly, it may also be necessary in certain situations to have a transparentized portion with extra flexibility. In such situations, an oligomer may be included with the coating. The preferred oligomers are selected from the group consisting of styrene-acrylic acid oligomers and urethane acrylate oligomers. Whether or not a prepolymer is included with the coating, however, it is preferable that the coating have a refractive index of about 1.5 after the coating has been cured. Further, the transparentized portion of the substrate preferably has a thickness in the range of from about 0.0005 to about 0.002 inches.

In addition to single sheet substrates, referred to above, which are imaged in non-impact printers and converted to mailers after imaging, a second category of mailers is used in high volume mailing operations. These mailers are pre-assembled, usually manufactured as a continuous series of individual mailers connected by perforations, and are imaged in impact printers. When a window is used in these mailers, a means must be included to provide name and address showing through the window. In the present invention, name and address are provided by the use of carbonless image coatings in combination with the transparentized portion of the top ply of the pre-assembled mailers.

In a preferred embodiment of the pre-assembled version of the invention, the substrate is in the form of an envelope or mailer having at least a first ply and a second ply. Preferably, the at least one transparentized portion is positioned on the first ply to form a transparentized window for addressee information. In addition to the above-recited transparentizing material, the transparentizing material may include color developer, preferably in the form of a CF reactant. Color former, preferably in the form of an encapsulated CB co-reactant, may then be placed on one surface of the transparentized portion, on the lower surface thereof, or on the upper surface of an intermediate sheet or ply placed beneath the transparentized portion. In this manner, upon the application of an imaging force to the transparentized portion, an image will be produced which is visible through and/or within the transparentized portion.

It is preferred that the cellulosic substrate of the present invention, when in the form of an already assembled envelope or mailer, include means for producing an image upon the application of an imaging force to the transparentized portion, such that the image will be visible through the transparentized portion. The image producing means may include a color developer, preferably in the form of a coating or dispersion of a high solids color developer-containing (CF) printing ink, in combination with a color former, preferably in the form of a coating or dispersion of a high solids, aqueous, microencapsulated color former-containing (CB) printing ink.

Many versions of the image producing means are provided. In one version, the image producing means comprises an intermediate sheet or ply positioned beneath the transparentized portion, the sheet having an upper surface which faces the lower surface of the transparentized portion, and a self-contained carbonless coating on the upper surface of the sheet such that, upon application of an imaging force, the self-contained carbonless coating forms an image. A self-contained carbonless coating is one in which CF and encapsulated CB co-reactants are layered or admixed on a support sheet. Optionally, CF reactant may be included within the transparentized portion such that, upon application of the imaging force, a second image is produced within the transparentized portion. As another option, a CF coating may be included on the lower surface of the transparentized portion, the CF coating facing the self-contained carbonless coating such that, upon application of the imaging force, the CF and self-contained carbonless coatings react to form an image.

In another version, the image producing means comprises an intermediate sheet or ply positioned beneath the transparentized portion, the sheet having an upper surface which faces the lower surface of the transparentized portion, a CF coating on the upper surface of the sheet, and a CB coating, containing encapsulated CB reactant, on the lower surface of the transparentized portion. Although CF reactant may be encapsulated instead of CB reactant, for consistency of illustration it will henceforth be assumed the CB reactant is encapsulated while the CF reactant is unencapsulated. The CB coating faces the CF coating such that, upon application of an imaging force, the CF and CB coatings react to forman image. Optionally, CF reactant may be included within the transparentized portion such that, upon application of the imaging force, a second image is produced within the transparentized portion.

In another version, the image producing means comprises an intermediate sheet or ply positioned beneath the transparentized portion, the sheet having an upper surface which faces the lower surface of the transparentized portion, a CF coating on the upper surface of the sheet, and a self-contained carbonless coating on the lower surface of the transparentized portion. The self-contained carbonless coating faces the CF coating such that, upon application of an imaging force, the CF and self-contained carbonless coatings react to forman image.

In yet another version, the image producing means comprises CF and encapsulated CB co-reactants within the transparentized portion such that, upon application of an imaging force, the CF and encapsulated CB co-reactants react to form an image.

In the most preferred form of the pre-assembled mailer, the cellulosic substrate of the present invention comprises the front ply of a mailer, the mailer including at least a second ply adjacent the front ply, the second ply having an upper surface which faces the lower surface of the front ply. More preferably, the front ply of the mailer has a CF or CB coating extending substantially entirely over the lower surface thereof, and the second ply has the other of a CF or CB coating extending substantially entirely over the upper surface thereof such that, upon application of an imaging force, the CF and CB coatings react to form an image.

In addition to the foregoing, the present invention provides a method of transparentizing a predetermined portion or portions of a cellulosic substrate, preferably such that a smooth interface exists between the transparentized portion and the remainder of the substrate, and preferably such that the transparentized portion has a thickness which is no greater than the thickness of the remainder of the substrate. In some embodiments, the method comprises making a predetermined portion of the substrate thinner than the remainder of the substrate such that the predetermined portion is rendered substantially transparent, and applying a transparentizing material to the predetermined portion. Preferably, such transparentizing coating material comprises one or more monomers selected from the group consisting of acrylic esters of polyhydric alcohols, methacrylic esters of polyhydric alcohols, and vinyl ethers.

Preferably, the transparentizing material is a 100% solids radiation curable coating, with the radiation curable coating further including a prepolymer or oligomer. Preferably, the prepolymer is selected from the group consisting of styrene-maleic anhydride prepolymer, styrene-acrylic acid prepolymer, and styrene-methacrylic acid prepolymer. Additionally, the radiation curable coating can include an oligomer such as a urethane acrylate oligomer or a styrene-acrylic oligomer.

As mentioned, the speed at which the above-recited monomeric transparentizing liquid coating penetrates allows transparentizing to occur in a continuous, in-line process. Such a process may be a continuous flexographic printing process in which the step of applying a radiation curable liquid to the predetermined portion occurs in the continuous flexographic printing process. The liquid is then cured immediately thereafter as a subsequent step in the continuous process. Preferably, those steps occur at a speed of about 75 to about 150 linear feet of substrate per minute.

To provide even faster penetration of the liquid into the substrate, the step of applying a radiation curable liquid to the predetermined portion can occur simultaneously to both the upper and lower surfaces of the predetermined portion.

In rendering the predetermined portion thinner than the remainder of the substrate, that may be accomplished by removing a portion of the thickness therefrom. The removal is preferably accomplished by mechanically grinding the portion. Preferably, the predetermined portion has a thickness ranging from about 0.0005 inches to about 0.002 inches following the grinding operation.

Alternatively, the predetermined portion can be made thinner by compressing, such as by calendaring the predetermined portion to a predetermined thickness. Preferably, such predetermined thickness ranges from about 0.0005 inches to about 0.002 inches following the compression of the predetermined portion.

Accordingly, it is a feature of the present invention to provide a cellulosic substrate which is suitable for use as a mailer or envelope and which has at least one transparentized portion. It is a further feature of the present invention to provide a cellulosic substrate having a transparentized portion which further includes carbonless printing capabilities to produce images under the transparentized portion and/or under the remainder of the substrate. These and other features and advantages of the present invention will become apparent from the following detailed description, the accompanying drawings, and the appended claims.

DETAILED DESCRIPTION OF THE PREFERRED EMBODIMENTS

Figure 1:
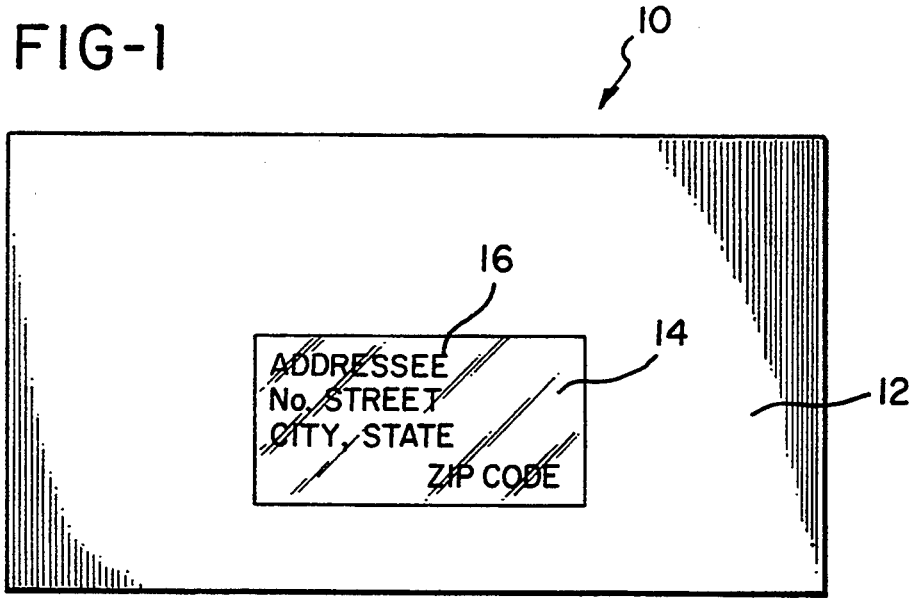
FIG. 1 is a front elevational view of a mailer having a transparentized portion showing addressee information, the mailer being formed from the cellulosic substrate of the present invention.

Referring now to FIG. 1, a mailer or envelope 10 can be formed from the cellulosic substrate 12 of the present invention. Substrate 12 includes a transparentized portion 14. Transparentized portion 14 allows addressee information 16, printed on the inside of mailer 10, to be viewed from the outside of mailer 10. Mailer 10 can be any type of mailer or envelope. For example, mailer 10 could be an inter-office mailer or one which is mailed through the U.S. Postal Service. In addition, mailer 10 could be designed to accept a facsimile transmission sheet directly from a facsimile transmission device in order to keep information contained within the facsimile transmission sheet confidential, except for addressee information.

Figure 2:
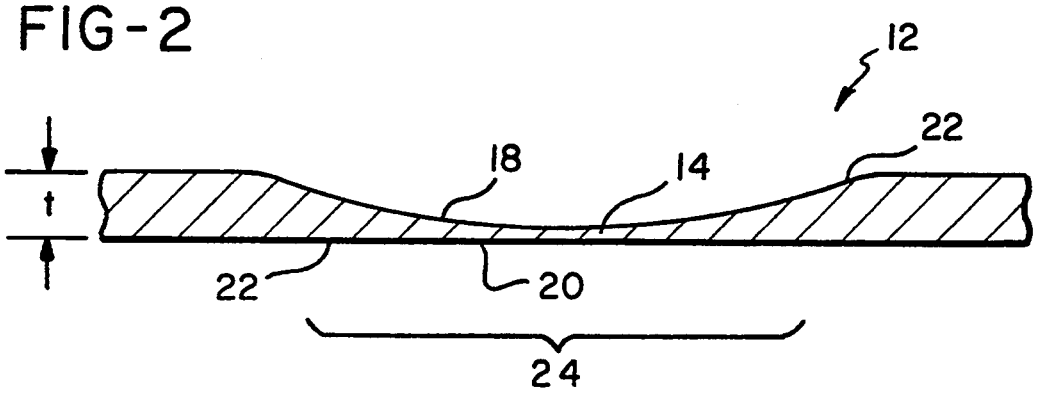
FIG. 2 is a cross-sectional view of the cellulosic substrate after the predetermined portion has been thinned by grinding or compression.
Figure 3:
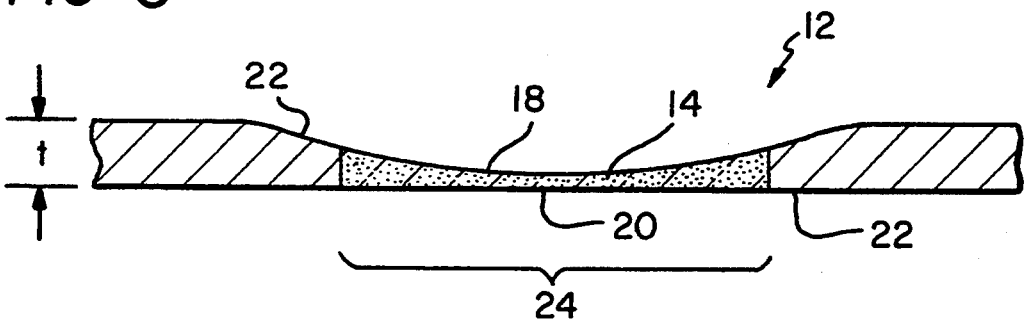
FIG. 3 is a cross-sectional view of the cellulosic substrate after the thinned portion has been impregnated with a transparentizing material.

Referring now generally to FIGS. 2 and 3, the features of the cellulosic substrate of the present invention will be described, where like reference numerals refer to like features. Transparentized portion 14 of substrate 12 has an upper surface 18 and a lower surface 20. When substrate 12 is used to form a mailer, upper surface 18 will be on the outside of the mailer, while lower surface 20 will be on the inside of the mailer. Transparentized portion 14 preferably has a smooth interface 22 between:

1) the upper surface 18 and lower surface 20 of transparentized portion 14 and
2) the remainder of substrate 12.

In this manner no loose or sharp edges are present on the substrate to get caught in printers or other process machinery.

In addition, transparentized portion 14 has a thickness which is less than the thickness "t" of the remainder of the substrate, as illustrated in FIGS. 2 and 3. As a consequence, transparentized portion 14 does not increase the thickness of substrate 12. Thus, numerous ones of substrate 12 can be placed into tall, stable stacks. As mentioned, such tall stacks are more convenient than short stacks and facilitate manufacturing and printing operations.

Referring now to FIG. 2, transparentized portion 14 of substrate 12 comprises an area 24 of substrate 12 which is sufficiently thinner than the remainder of substrate 12. Area 24 can be any predetermined portion of substrate 12 whereat it is desired to place a transparentized portion.

Area 24 may be made thinner than the remainder of substrate 12 by removing a section of the thickness therefrom or by compressing it. It is preferred that transparentized portion 14 have a thickness ranging from about 0.0005 inches to about 0.002 inches following the removal of or compression of the section from area 24. Although FIG. 2 shows the reduction in thickness as having been performed on the upper surface 18 of transparentized portion 14, it can also be performed to the lower surface 20.

In one embodiment, thinning of area 24 is accomplished by mechanically grinding away the section. A preferred means of grinding away the section of area 24 is by passing substrate 12 between a large roll and a smaller, grinding roll. Raised projections of the desired size and shape of transparentized portion 14 are placed upon the large roll. In this manner, substrate 12 will be ground away by the grinding roll in the shape of the raised projection. Such grinding equipment is readily available commercially. An example of a suitable grinding apparatus is illustrated in U.S. Pat. No. 4,814,043 to Rausing et al., the disclosure of which is incorporated herein by reference. It is preferred that the shape of the raised projections allow small holes to be formed in transparentized portion 14. The preferred hole size is 0.10 mm or larger.

Area 24 can also be made thinner than the remainder of substrate 12 by compressing substrate 12 at area 24 to a predetermined thickness. Preferably, such predetermined thickness ranges from about 0.0005 inches to about 0.002 inches following the compression of substrate 12 at area 24. More preferably, the predetermined thickness is 0.001 inch or less. The preferred technique for compressing substrate 12 at area 24 is by calendaring substrate 12, using calendaring equipment, but only at area 24. In this manner, area 24 will be thinner, and have a higher density, than the remainder of substrate 12. Compression in selected area may be accomplished by a pair of rotating cylinders, one of which has raised areas on its surface corresponding to areas to be compressed.

As shown in FIG. 3 portion 14 of substrate 12 is then impregnated with a radiation curable liquid transparentizing material. Portion 14 can be any predetermined portion of substrate 12 where it is desired to place a transparentized portion. The radiation curable liquid comprises one or more monomers selected from the group consisting of vinyl ethers and acrylic and methacrylic esters of polyhydric alcohols. Representative examples include: ethylene glycol diacrylate, ethylene glycol dimethacrylate, trimethylolpropane triacrylate, pentaerythritol tetramethacrylate, dipentaerythritol hydroxy pentacrylate, 1,6-hexanediol diacrylate, diethylene glycol dimethacrylate. A representative example of a vinyl ether monomer is vinyl pyrrolidone.

Such monomers are aliphatic and have one or more ethylenically unsaturated groups. It has been found that when one or more of these monomers, without oligomers or prepolymers, are included in a radiation curable transparentization coating, the liquid coating penetrates a cellulosic substrate quite rapidly. It is believed that the rapid penetration is due, in part, to the inherently low viscosity of such monomers. Thus, the coating can be a "100% solids" one and still achieve a rapid rate of penetration. "100% solids" means a liquid material which can be converted 100% to a solid upon curing (i.e. crosslinking or polymerization). Thus, it contains no residual volatiles or solvents. However, if even faster penetration is desired, an organic solvent can be added to the coating to further lower the viscosity thereof. Preferred solvents include isopropanol, methyl ethyl ketone, toluene, and hexyl carbitol (hexyl ether of diethylene glycol).

Preferably, the coating is cured by exposing the coating to one of two types of radiation—either electron beam radiation or ultraviolet radiation. Curing the coating causes the constituents to polymerize, thus making a permanently transparentized portion. Once the coating is cured, it is a solid and will not migrate or volatilize. Advantageously, the rapidity with which the present liquid transparentizing material penetrates the substrate allows curing thereof almost immediately following its application to the substrate, thus providing substantially no opportunity for the coating to migrate or volatilize.

If electron beam curing is employed, no photocatalyst is needed. However, if curing is carried out by exposing the coating to ultraviolet radiation, a photocatalyst needs to be included with the coating. Preferably, the photocatalyst is of the free radical type. A wide variety of such photocatalysts can be used provided they do not deleteriously affect the desired physical and chemical properties of the resultant transparentized portion. Examples of useful free radical photocatalysts include an alkyl benzoin ether, such as benzoin ether benzophenone, a benzophenone with an amine such as methyl diethanolaminedimethylquinoxiline 4,4' bis (di methylaminebenzophenone), and acetophenones such as 2,2 diethoxyacetophenone and t-butyl trichloroacetophenone. A preferred class of useful free radical photocatalysts are haloalkyl substituted aryl ketone compounds. All such photocatalysts, useful in the practice of this invention, are either readily available commercially or are easily prepared using known techniques.

The speed at which the monomeric radiation curable liquid of the present invention penetrates substrate 12 allows transparentizing to occur in a continuous, in-line process. Such a process can include any conventional printing method such as flexographic, gravure, or screen. A continuous transparentization process can be set up in which the radiation curable liquid is first applied to area 24 in a flexographic printing press and then cured immediately thereafter by electron beam or ultraviolet radiation.

In the case of a flexographic printing press in combination with ultraviolet curing, for example, an acceptable rate of transparentization (i.e., applying the coating to substrate 12 and curing it) is from about 75 to about 150 linear feet of substrate per minute. Obviously faster production speeds are usually preferred. One expedient for increasing production speed is to mildly heat the substrate and/or liquid material (50°–90° C.) to effectively reduce viscosity and increase the penetration rate. The preferred viscosity of the coating at 25° C. is from about 50 to about 100 centipoise-and more preferably from about 50 to about 70 centipoise. The preferred wavelength of the ultraviolet curing light is from about 200 to about 400 nanometers, and the preferred ultraviolet curing light capacity is from about 300 to about 400 watts per inch of substrate width.

The liquid transparentizing material can be applied to one or both sides of substrate 12 at area 24. It is preferred, however, that it be applied simultaneously to both sides of area 24. Such simultaneous application provides even faster penetration of the liquid into the substrate.

Advantageously, the use of one or more of the above-recited monomers, without oligomers or prepolymers, results in a coating which not only penetrates substrate 12 very quickly, but also produces a transparentized portion 14 which meets all of the desired physical and chemical properties. Physically, transparentized portion 14 is strong, flexible and durable such that it will maintain its transparency when subjected to rough handling. In addition, transparentized portion 14 is highly receptive to inks. An advantage of such good receptivity to inks is that it allows a reverse image to be printed on the lower surface of the transparentized portion. This feature will be explained in greater detail below.

Chemically, transparentized portion 14 has sufficient resistance to ultraviolet radiation that it does not yellow and/or lose its transparency over time. It is believed that such resistance to ultraviolet radiation is a result of the aliphatic, as opposed to aromatic, structure of the above-recited monomers. Further, the transparentized portion meets U.S. Postal Service specifications for reflectance and PCR. This is believed possible due to the fact that the above-recited monomers achieve substantially complete penetration of substrate 12. Additionally, transparentized portion 14 has sufficient resistance to migration and/or volatilization of the radiation cured coating that it does not lose its transparency over time. Due to the rapid penetration of the coating into substrate 12, the coating can be cured almost immediately after it has been applied to area 24. Moreover, when the coating is 100% solids, it is less mobile and less volatile after curing than one containing a solvent, thus further reducing the tendency to migrate or volatilize.

It is preferred that the transparentizing material, once cured, has a refractive index as close as possible to that of substrate 12. This will ensure that the transparentized portion will be sufficiently transparent. Most cellulosic substrates have a refractive index of around 1.5. Thus, the preferred refractive index of the cured coating is similarly around 1.5. When the coating is comprised of one or more of the above-recited monomers, without oligomers or prepolymers, the refractive index of the cured coating ranges from about 1.48 to about 1.5. Under most circumstances, this matches closely enough with that of the cellulosic substrate that the transparentized portion will be sufficiently transparent.

However, some cellulosic substrates have a refractive index which is greater than 1.5. With such substrates, it may be desirable to include one or more prepolymers with the coating in order to increase the refractive index of the cured coating to substantially match that of the substrate. Typically, 1.55 is the highest value that the refractive index of the cured coating will need to attain in this manner. The preferred prepolymers for this function include styrene-maleic anhydride, styrene-acrylic acid and, styrene-methacrylic acid. The most preferred prepolymer of this group is styrene-maleic anhydride.

It may also be desirable in certain situations to have a transparentized portion with extra flexibility. For this purpose, an oligomer may be included with the coating. The preferred oligomers in this instance are urethane acrylate oligomer and styrene-acrylic oligomer.

Further, an amine may be included with the coating in order to reduce the curing time thereof. The preferred amine for this purpose is trierhanoi amine.

In an alternative embodiment of the invention, the transparentizing material may comprise a CF reactant. In this manner, area 24 can be impregnated with a "CF ink" in order to produce transparentized portion 14. "CF ink" is a non-curing, permanently fluid material containing dissolved CF reactant. The preferred CF reactant for this purpose is a type which contains a phenolic resin. Encapsulated CB co-reactant may then be placed within transparentized portion 14, or on lower surface 20, or on the upper surface of an intermediate sheet placed beneath transparentized portion 14. In this manner, upon the application of an imaging force to transparentized portion 14, an image will be produced which is visible through and/or within transparentized portion 14. CF and CB reactants are discussed in greater detail immediately below.

As used herein, the terms CF and CB have their well-understood meanings in this art. That is CF denotes "coated front" and typically contains dispersed particles of an acidic color-developing co-reactant. CB denotes "coated back" and typically contains an encapsulated solution of color-forming leuco dyes. A self-contained coating is one which contains both co-reactants on a single surface.

Referring now generally to FIGS. 4–9, various alternative aspects of the image producing feature of the present invention will be described. In general, it is preferred that the cellulosic substrate of the pre-assembled version of the present invention include means for producing an image upon the application of an imaging force to transparentized portion 14, such that the image will be visible through transparentized portion 14. By an imaging force, it is meant a force applied to the substrate sufficient to cause the CF and CB co-reactants to mix and react to form a color. Typically, such an imaging force may be provided by the print head of an impact printer. Further, it is preferred to include means for producing an image on another ply below substrate 12 upon application of an imaging force to the remainder of substrate 12. In this manner, when the present cellulosic substrate is used to form a pre-assembled mailer, addressee and other information can be conveniently produced by applying an imaging force at discrete locations on transparentized portion 14, and on the remainder of substrate 12. Further, while the preferred embodiment of the invention has been illustrated, it will be apparent that the carbonless imaging aspects of the invention are also useful when utilized in combination with transparentized portions of the substrate, whether or not these portions have been thinned.

As provided by the present invention, the image producing feature includes various combinations of color developer and color former which react to form an image upon the application of an imaging force. Suitable color developers include phenolic-type resins such as acetylated phenolic resins, salicylic acid modified phenolics, and novolac type phenolic resins. Even more preferred for use is a high solids color developer-containing (CF) printing ink which includes water, a non-volatile diluent, and an acidic color developer. The ink preferably has a 50–70% by weight solids content. See, U.S. Pat. No. 5,084,492, the disclosure of which is hereby incorporated by reference.

Well known color formers include those initially colorless chromogenic dye precursors such as Crystal Violet Lactone, 4,4'-bis(diethylamino)benzhydrol, Benzoyl Leuco Methylene Blue, Indolyl Red, Malachite Green Lactone, 8-methoxybenzoindoline spiropyran, and Rhodamine Lactone. Even more preferred is a high solids content, aqueous, microcapsule-containing (CB) printing ink which is prepared by an interfacial polymerization or crosslinking in which a crosslinking agent such as a polyisocyanate is dissolved in an oily solution which serves as the internal phase of the microcapsules. The oily solution contains an oily solvent and a dye precursor capable of reacting with a color developer to form a color. Preferably, the ink has a solids content in the range of approximately 60–70% by weight. See U.S. Pat. No. 4,940,739, the disclosure of which is incorporated herein by reference.

As shown generally in FIGS. 4–9, cellulosic substrate 12 with transparentized portion 14 is shown with underlying sheet or ply 26 positioned beneath substrate 12 and transparentized portion 14. Underlying sheet 26 has an upper surface 28 which faces lower surface 20 of transparentized portion 14, and also faces lower surface 30 of the remainder of substrate 12. If formed into a mailer, substrate 12 would be the front ply, transparentized portion 14 would be the transparent window, and underlying sheet 26 could either be an insert ply inside of the mailer or the back ply of the mailer.

Figure 4:
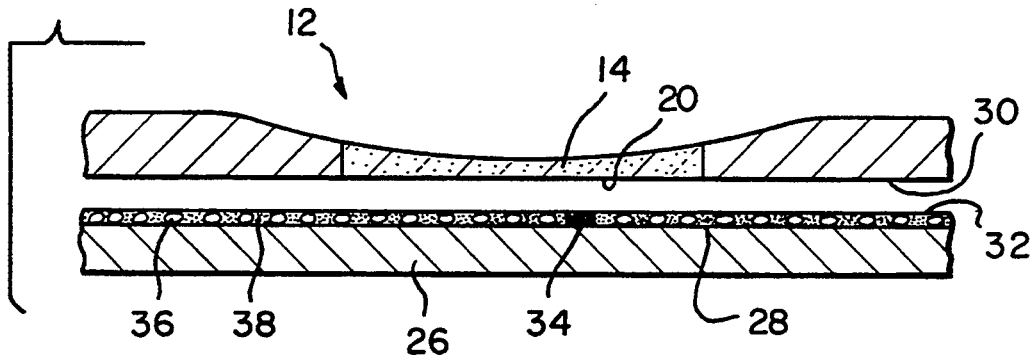
FIG. 4 is a cross-sectional view of the cellulosic substrate of FIG. 3 in combination with a self-contained carbonless coating on an intermediate ply which is positioned beneath the substrate.

Referring now specifically to FIG. 4, a self-contained carbonless coating 32 is shown on the upper surface 28 of underlying sheet 26 such that, upon application of an imaging force, self-contained carbonless coating 32 forms an image 34 on upper surface 28 of underlying sheet 26. As is well known, image 34 is formed due to the breakage of capsules 36 within self-contained carbonless coating 32 upon application of an imaging force. Either CB or CF reactant can be encapsulated within capsules 36. For consistency of illustration, however, CB reactant will be deemed encapsulated within capsules 36, while CF reactant 38 will be deemed to be unencapsulated. It is to be understood that such designation is for illustration purposes only, and that CF could have been designated as the encapsulated reactant.

When capsules 36 are broken by an imaging force, CB reactant contained therein comes into contact with CF reactant 38 to form image 34. Image 34 is visible through transparentized portion 14. In this manner, addressee or other information can be formed on underlying sheet 26 by applying an imaging force to transparentized portion 14, and this information will be visible through transparentized portion 14.

Self-contained carbonless coating 32 is shown in FIG. 4 as a full coating on upper surface 28 of underlying sheet 26. In this manner, other images can be formed thereon which are not visible through transparentized portion 14, but which could only be seen once substrate 12 was separated from underlying sheet 26. Alternatively, a partial coating of self-contained carbonless coating 32 could be used. As such, the self-contained coating may be applied exclusively beneath transparentized portion 14 such that an image is formed thereunder but not under the remainder of substrate 12. Alternatively, a partial self-contained coating may be randomly applied on the upper surface 28 of underlying sheet 26.

Optionally, CF reactant may be included within transparentized portion 14, close to lower surface 20, such that, upon application of an imaging force, the CF and self-contained carbonless coating 32 react to form a second image (not shown) within transparentized portion 14. As another option, a CF coating may be included on lower surface 20 such that, upon application of the imaging force, the CF and self-contained carbonless coatings react to form a second image (not shown) on lower surface 20.

Figure 5:
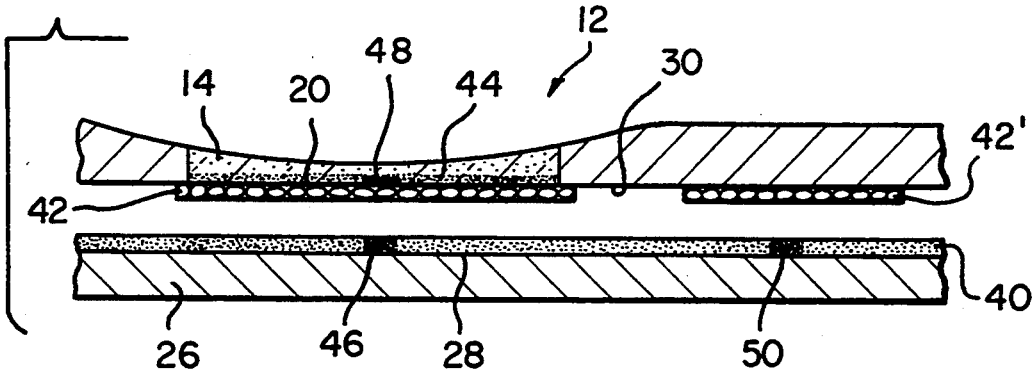
FIG. 5 is a cross-sectional view of the cellulosic substrate of FIG. 3 in combination with CF reactant within the transparentized portion, a CB coating beneath the transparentized portion and beneath discrete portions of the remainder of the substrate, and a CF coating on an intermediate ply positioned beneath the substrate.

Referring now to FIG. 5, a CF coating 40 is shown on upper surface 28 of underlying sheet 26. CF coating 40 may be a full or partial coating. Partial CB coatings 42 and 42' are contained on lower surface 20 of transparentized portion 14, and on portions of lower surface 30 of the remainder of substrate 12, respectively. Further, CF reactant 44 is included within transparentized portion 14. Upon application of an imaging force to transparentized portion 14, CF coating 40 reacts with CB coating 42 to form first image 46 on the upper surface 28 of underlying sheet 26. Simultaneously, CB coating 42 reacts with CF reactant 44 to form second image 48 within transparentized portion 14. Second image 48 is identical to first image 46. In addition, upon application of an imaging force to the remainder of substrate 12 in the vicinity of CB coating 42", CF coating 40 reacts with CB coating 42' to form third image 50 on the upper surface 28 of underlying sheet 26.

First image 46 is visible through transparentized portion 14. Second image 48 is visible in transparentized portion 14, and has the advantage of enhancing the readability of first image 46. This feature also facilitates the readability of the images by U.S. Postal Service scanners. Further, second image 48, being incorporated within transparentized portion 14, cannot be altered by external means. Since second image 48 is identical to first image 46, it will be readily apparent if first image 46 has been altered by external means. Thus, second image 48 provides a measure of security.

Figure 6:
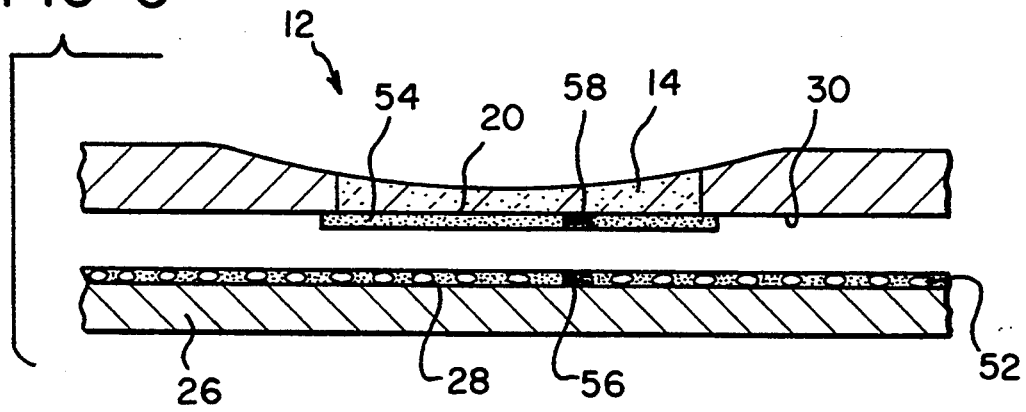
FIG. 6 is a cross-sectional view of the cellulosic substrate of FIG. 3 in combination with a CF coating beneath the transparentized portion and a self-contained carbonless coating on an intermediate ply positioned beneath the substrate.

Referring now to FIG. 6, a self-contained carbonless coating 52 is shown on upper surface 28 of underlying sheet 26. Although shown as a full coating, this coating could be a partial coating or a series of coated areas. A partial CF coating 54 is contained on lower surface 20 of transparentized portion 14. CF coating 54 could also be a full coating. Upon application of an imaging force to transparentized portion 14, CF coating 54 reacts with self-contained carbonless coating 52 to form a first image 56 on the upper surface 28 of underlying sheet 26, and also an identical second image 58 on the lower surface 20 of transparentized portion 14.

First image 56 is visible through transparentized portion 14. Second image 58 is similarly visible through transparentized portion 14, and has the advantage of enhancing the readability of first image 56.

Figure 7:
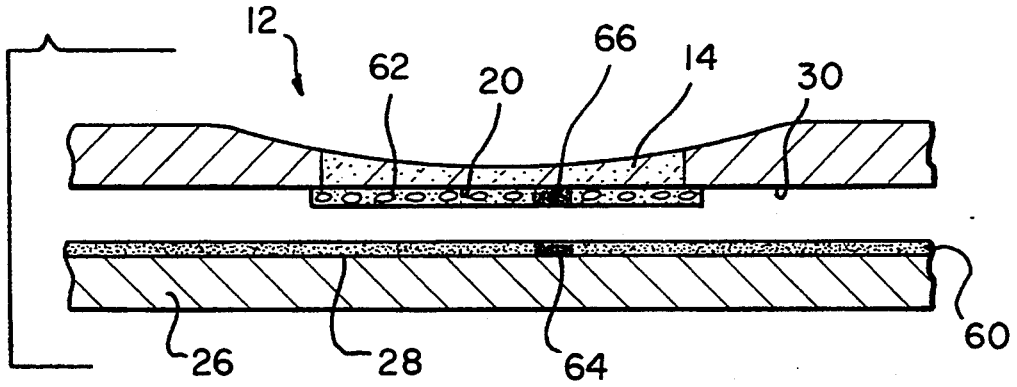
FIG. 7 is a cross-sectional view of the cellulosic substrate of FIG. 3 in combination with a self-contained carbonless coating beneath the transparentized portion and CF coating on an intermediate ply positioned beneath the substrate.

Referring now to FIG. 7, a CF coating 60 is shown on upper surface 28 of underlying sheet 26. Although shown as a full coating, this coating could be a partial coating or series of coated areas. A partial self-contained carbonless coating 62 is contained on lower surface 20 of transparentized portion 14. Self-contained carbonless coating 62 could also be a full coating. Upon application of an imaging force to transparentized portion 14, CF coating 60 reacts with self-contained carbonless coating 62 to form a first image 64 on the upper surface 28 of underlying sheet 26, and also an identical second image 66 on the lower surface 20 of transparentized portion 14.

First image 64 is visible through transparentized portion 14. Second image 66 is similarly visible through transparentized portion 14, and has the advantage of enhancing the readability of first image 64.

Figure 8:
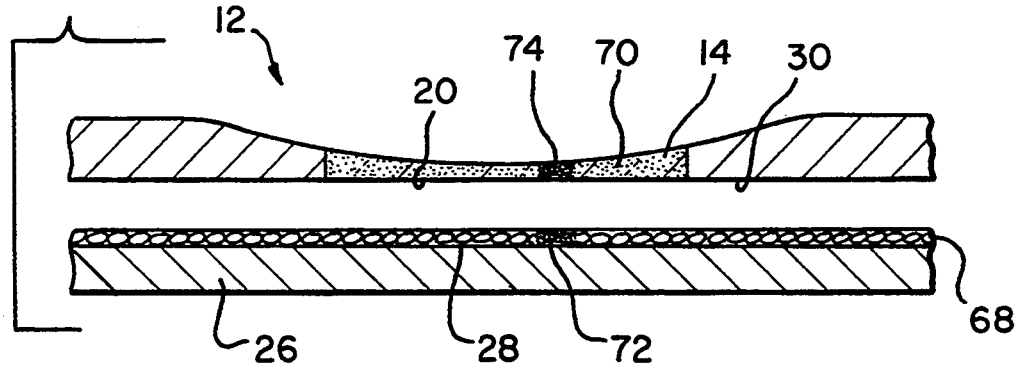
FIG. 8 is a cross-sectional view of the cellulosic substrate of FIG. 3 in combination with CF reactant within the transparentized portion and a self-contained carbonless coating on an intermediate ply positioned beneath the substrate.

Referring now to FIG. 8, a CB coating 68 is shown on upper surface 28 of underlying sheet 26. Although shown as a full coating, this coating could be a partial coating. Moreover, this coating could be a self-contained carbonless coating instead of a CB coating. CF reactant 70 is included within transparentized portion 14. Moreover, CF reactant 70 could itself be a transparentizing material, as discussed above, or could be used in combination with another transparentizing material.

Upon application of an imaging force to transparentized portion 14, CF reactant 70 reacts with CB coating 68 to form a first image 72 on the upper surface 28 of underlying sheet 26, and also an identical second image 74 within transparentized portion 14. First image 72 is visible through transparentized portion 14. Second image 74 is visible in transparentized portion 14.

Figure 9:
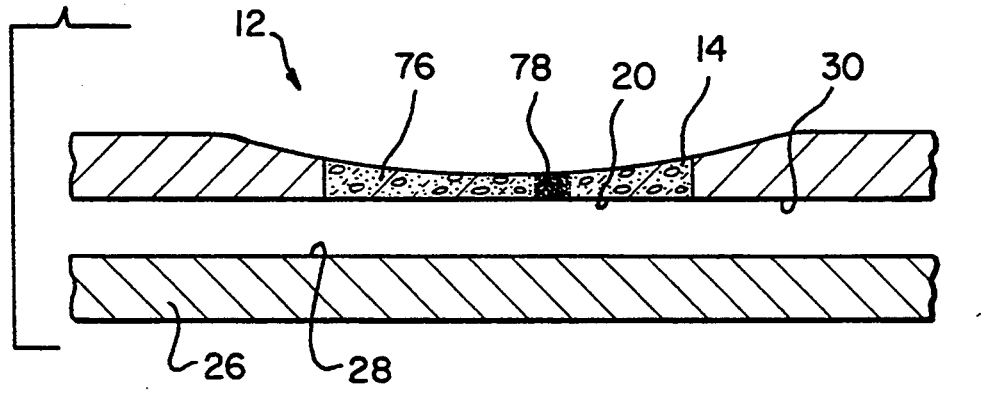
FIG. 9 is a cross-sectional view of the cellulosic substrate of FIG. 3 in which CF and encapsulated CB co-reactants are contained within the transparentized portion.

Referring now to FIG. 9, CF and encapsulated CB co-reactants 76 are shown within transparentized portion 14. Upon application of an imaging force to transparentized portion 14, the CF and encapsulated CB co-reactants react to form image 78. Image 78 is visible within transparentized portion 14.

Figure 10:
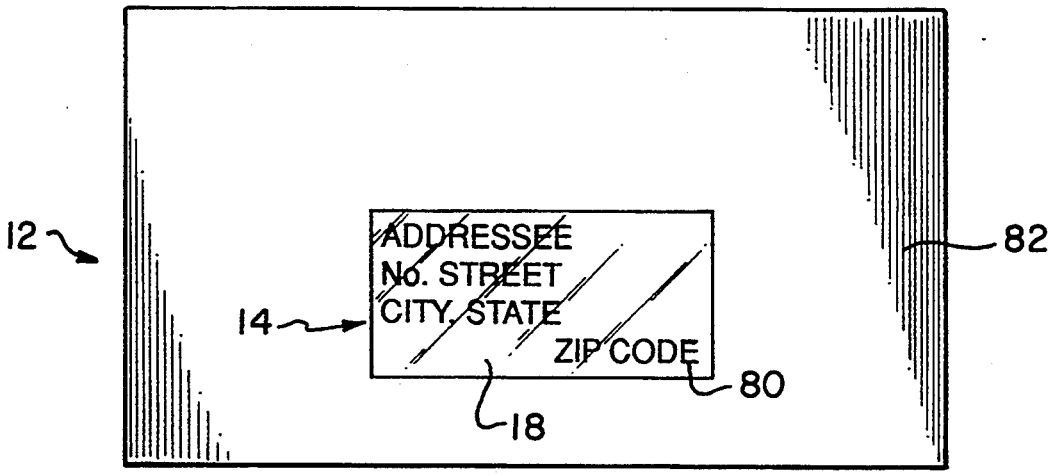
FIG. 10 is an elevational view through the upper surface of the cellulosic substrate of FIG. 3 in which a reverse image is printed on the lower surface of the transparentized portion.
Figure 11:
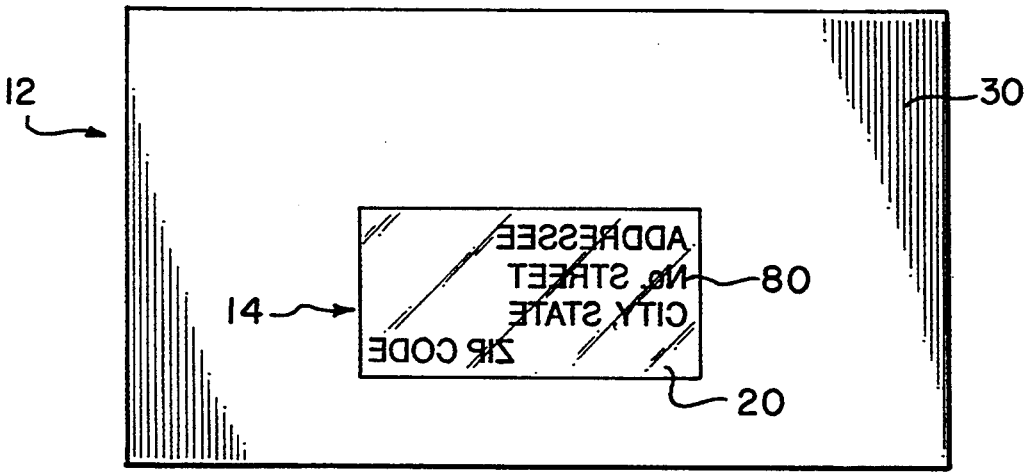
FIG. 11 is a front elevational view of the lower surface of the cellulosic substrate shown in FIG. 10.

Referring now to FIGS. 10 and 11, the reverse image printing feature of the present invention will be discussed. FIG. 11 is a view of the lower surface 30 of substrate 12 and shows reverse image 80, which has been printed on the lower surface 20 of transparentized portion 14. Reverse image 80 can be printed with any conventional printing means, such as a laser printer. FIG. 10 is a view from the upper surface 82 of substrate 12 and shows reverse image 80 as it appears through the upper surface 18 of transparentized portion 14—as a normal image. When substrate 12 is used to form a mailer, the normal image of reverse image 80 is the image that will be seen by the observer.

In order that the invention may be more readily understood, reference is made to the following examples, which are intended to be illustrative of the invention, but are not intended to be limiting in scope.

EXAMPLE 1

A radiation curable liquid transparentizing material was prepared in accordance with the present invention by blending the materials listed below. The liquid was then applied to a substrate by flexographic printing and cured by ultraviolet radiation at a wavelength of from about 200 to about 400 nanometers.

| | Percent by weight |
|---|---|
| Styrene-maleic anhydride[1] | 7.24 |
| 1,6 Hexanedioldiacrylate[2] | 31.49 |
| Trimethylolpropane triacrylate[3] | 34.48 |
| Monohydroxy pentacrylate[4] | 4.82 |
| Urethane acrylate[5] | 10.34 |
| Photocatalyst[6] | 12.40 |

[1]SMA 1000A from Arco Chemical
[2]SR-238 from Sartomer
[3]SR-351 from Sartomer
[4]SR-9041 from Sartomer
[5]CN-962 from Sartomer
[6]Iracure 500 from Ciba Geigy

EXAMPLE 2

A radiation curable transparentizing liquid was prepared as in Example 1 using the following materials:

| | Percent by Weight |
|---|---|
| Styrene-maleic anhydride[1] | 6.67 |
| 1,6 Hexanedioldiacrylate[2] | 62.60 |
| Trimethylolpropane triacrylate[3] | 20.86 |
| Photocatalyst[4] | 9.84 |

[1]SMA 1000A from Arco Chemical
[2]SR-238 from Sartomer
[3]SR-351 from Sartomer
[4]Iracure 500 from Ciba Geigy

EXAMPLE 3

A radiation curable transparentizing liquid was prepared as in Example 1 using the following materials:

| | Percent by Weight |
|---|---|
| 1,6 Hexanedioldiacrylate[1] | 78.86 |
| Urethane acrylate[2] | 8.00 |
| Photocatalyst[3] | 13.04 |

[1]SR-238 from Sartomer
[2]CN-962 from Sartomer
[3]Iracure 500 from Ciba Geigy

EXAMPLE 4

A radiation curable transparentizing liquid was prepared as in Example 1 using the following materials:

| | Percent by Weight |
|---|---|
| Styrene-maleic anhydride[1] | 6.58 |
| 1,6 hexanedioldiacrylate[2] | 27.90 |
| Trimethylolpropane triacrylate[3] | 31.34 |
| Monohydroxy Pentacrylate[4] | 4.38 |
| Urethane acrylate[5] | 9.40 |
| Hexyl carbitol | 9.08 |
| Photocatalyst[6] | 11.20 |

[1]SMA 1000A from Arco Chemical
[2]SR-238 from Sartomer
[3]SR-351 from Sartomer
[4]SR-9041 from Sartomer
[5]CN-962 from Sartomer
[6]Iracure 500 from Ciba Geigy

EXAMPLE 5

A radiation curable transparentizing liquid was prepared as in Example 1 using the following materials:

| | Percent by Weight |
|---|---|
| 1,6 Hexanedioldiacrylate[1] | 33.50 |
| Trimethylolpropane triacrylate[2] | 47.86 |
| Monohydroxy Pentacrylate[3] | 7.01 |
| Urethane acrylate[4] | 3.19 |
| Triethanol amine | 2.55 |
| Photocatalyst[5] | 5.87 |

[1]SR-238 from Sartomer
[2]SR-351 from Sartomer
[3]SR-9041 from Sartomer
[4]CN-962 from Sartomer
[5]Iracure 500 from Ciba Geigy

EXAMPLE 6

A radiation curable transparentizing liquid was prepared as in Example 1 using the following materials:

| | Percent by Weight |
|---|---|
| 1,6 Hexanedioldiacrylate[1] | 27.50 |
| Trimethylolpropane triacrylate[2] | 39.37 |
| Monohydroxy pentacrylate[3] | 5.51 |
| Vinyl pyrrolidone | 15.70 |
| Photocatalyst[4] | 11.81 |

[1]SR-238 from Sartomer
[2]SR-351 from Sartomer
[3]SR-9041 from Sartomer
[4]Iracure 500 from Ciba Geigy

EXAMPLE 7

A radiation curable transparentizing liquid was prepared as in Example 1 using the following materials:

| | Percent by Weight |
|---|---|
| 1,6 Hexanedioldiacrylate[1] | 28.22 |
| Trimethylolpropane triacrylate[2] | 40.32 |
| Monohydroxy pentacrylate[3] | 5.64 |
| Tripropylene glycol diacrylate[4] | 16.12 |
| Photocatalyst[5] | 9.67 |

[1]SR-238 from Sartomer
[2]SR-351 from Sartomer
[3]SR-9041 from Sartomer
[4]Photomer 4061 from Henkel
[5]Iracure 500 from Ciba Geigy While a representative embodiment and certain details have been shown for purposes of illustrating the invention, it will be apparent to those skilled in the art that various changes in the methods and apparatus disclosed herein may be made without departing from the scope of the invention, which is defined in the appended claims.

What is claimed is:

1. A cellulosic substrate suitable for use as an envelope or mailer and having at least one transparentized portion, said transparentized portion comprising an area of said substrate which is thinner than the remainder of said substrate and which has been impregnated with a polymerizable transparentizing material such that a smooth interface exists between said transparentized portion and the remainder of said substrate, said transparentizing material comprising at least one monomer selected from the group consisting of acrylic esters of polyhydric alcohols, methacrylic esters of polyhydric alcohols, and vinyl ethers which has been cured by exposure to radiation.

2. The substrate of claim 1 wherein said monomer was applied to said substrate as a 100% solids liquid.

3. The substrate of claim 1 wherein said polymerizable transparentizing material further includes a prepolymer or oligomer.

4. The substrate of claim 3 wherein said prepolymer is selected from the group consisting of styrene-maleic anhydride prepolymer, styrene-acrylic acid prepolymer, and styrene-methacrylic acid prepolymer.

5. The substrate of claim 3 wherein said oligomer is selected from the group consisting of styrene-acrylic acid oligomer and urethane acrylate oligomer.

6. The substrate of claim 1 wherein said transparentizing polymeric material has a refractive index of about 1.5 when cured.

7. The substrate of claim 1 wherein said transparentized portion has a thickness in the range of from about 0.0005 to about 0.002 inches.

8. The substrate of claim 1 wherein said monomer is characterized by having one or more ethylenically unsaturated groups per monomer molecule.

9. The substrate of claim 1 wherein said substrate is in the form of an envelope or mailer having at least a first ply and a second ply, with said transparentized portion on said first ply.

10. The substrate of claim 9 further including color forming and color developing components for producing an image which may be viewed through or within said transparentized portion upon the application of an imaging force.

11. The substrate of claim 10 further including an intermediate ply underlying said transparentized portion on said first ply, and said color forming and color developing components are contained within said transparentized portion, or in one or more coatings on the facing surfaces of said transparentized portion of said first ply and said intermediate ply.

12. The substrate of claim 11 wherein a self-contained coating is on the surface of said intermediate ply facing said transparentized portion of said first ply such that upon application of said imaging force, an image is formed in said self-contained coating.

13. The substrate of claim 12 wherein said transparentizing material includes a color developing reactant such that upon application of said imaging force, an image is also formed in said transparentized portion.

14. The substrate of claim 12 wherein said transparentized portion has a coating on its surface which faces said intermediate ply containing a color developing reactant such that upon application of said imaging force, an image is also formed in said coating.

15. The substrate of claim 11 in which said transparentized portion has a CB coating on its surface which faces said intermediate ply, and the facing surface of said intermediate ply has a CF coating.

16. The substrate of claim 11 in which said transparentized portion has a CF coating on its surface which faces said intermediate ply, and the facing surface of said intermediate ply has a CB coating.

17. The substrate of claim 11 wherein a self-contained coating is on the surface of said transparentized portion of said first ply facing said intermediate ply such that upon application of said imaging force, an image is formed in said self-contained coating.

18. A cellulosic envelope or mailer having at least a first ply and a second ply, and having at least one transparentized portion comprising an area of said first ply which has been impregnated with a polymerizable transparentizing material such that a smooth interface exists between said transparentized portion and the reminder of said first ply, wherein said transparentizing material is a polymer consisting of aliphatic monomers selected from the group consisting of acrylic esters of polyhydric alcohols, methacrylic esters of polyhydric alcohols, and vinyl ethers which has been cured by exposure to radiation, said cellulosic envelope or mailer further including color forming and color developing components contained within said transparentized portion, for producing an image in said transparentized portion upon the application of an imaging force.

19. The envelope or mailer of claim 18 further including an intermediate ply underlying said transparentizing portion of said first ply, and wherein said self-contained coating is contained within said transparentized portion, on the facing surface of said transparentized portion of said first ply, or on the surface of said intermediate ply.

20. The envelope or mailer of claim 19 wherein said self-contained coating is on the surface of said intermediate ply facing said transparentized portion of said first ply such that upon application of said imaging force, an image is formed in said self-contained coating.

21. The envelope or mailer of claim 20 wherein said transparentizing material includes a color developing reactant such that upon application of said imaging force, an image is also formed in said transparentized portion.

22. The envelope or mailer of claim 19 wherein said transparentized portion has a coating on its surface which faces said intermediate ply containing a color developing reactant such that upon application of said imaging force, an image is also formed in said coating.

23. The envelope or mailer of claim 19 in which said transparentized portion has a CB coating on its surface which faces said intermediate ply, and the facing surface of said intermediate ply has a CF coating.

24. The envelope or mailer of claim 19 in which said transparentized portion has a CF coating on its surface which faces said intermediate ply, and the facing surface of said intermediate ply has a CB coating.

25. The envelope or mailer of claim 19 wherein said self-contained coating is on the surface of said transparentized portion of said first ply facing said intermediate ply such that upon application of said imaging force, an image is formed in said self-contained coating.

26. The envelope or mailer of claim 18 wherein said transparentizing material is solventless.

* * * * *